United States Patent [19]

Saisho

[11] Patent Number: 4,769,840

[45] Date of Patent: Sep. 6, 1988

[54] RECEIVER FOR SOUND MULTIPLEX BROADCAST

[75] Inventor: Akito Saisho, Gifu, Japan

[73] Assignee: Sanyo Electric Co., Ltd., Osaka, Japan

[21] Appl. No.: 10,669

[22] Filed: Feb. 4, 1987

[30] Foreign Application Priority Data

Feb. 5, 1986 [JP] Japan ..... 61-23628

[51] Int. Cl.[4] ..... H04H 5/00

[52] U.S. Cl. ..... 381/13; 381/98; 358/144

[58] Field of Search ..... 381/2, 3, 4, 13, 98; 358/143, 144

[56] References Cited

U.S. PATENT DOCUMENTS 4,405,944 9/1983 Eilers et al. ..... 358/144

4,577,226 3/1986 Avins ..... 381/13

*Primary Examiner*—Forester W. Isen

*Attorney, Agent, or Firm*—Armstrong, Nikaido, Marmelstein & Kubovcik

[57] ABSTRACT

A sound multiplex broadcast receiver wherein a SAP channel for a subchannel carrier wave audio signal is provided independently of a channel for the main audio signal to demodulate the subchannel audio signal by way of a noise reduction circuit. The receiver comprises a frequency characteristics correction circuit for correcting the frequency characteristics of the demodulated subchannel audio signal by diminishing the gain at a specific frequency where the distortion factor of the noise reduction circuit reaches a peak, and a noise detection circuit for detecting the level of noise in the audio signal received. The amount of correction by the correction circuit is controlled by the output of the noise detection circuit which varies with the intensity of electric field received, permitting the noise reduction circuit to produce a SAP signal output with flat frequency characteristics.

2 Claims, 6 Drawing Sheets

RECEIVER FOR SOUND MULTIPLEX BROADCAST

FIELD OF THE INVENTION

The present invention relates to a receiver for receiving sound multiplex television broadcast.

PRIOR ART

The conventional sound multiplex television systems include the so-called Zenith system proposed in U.S. Pat. No. 4,405,944. with reference to the frequency spectrum of FIG. 8, this system is characterized in that a SAP (separate audio program) channel for a second language or like subchannel audio signal is provided independently of a stereophonic difference signal (L−R) channel and that a pilot signal indicating presence or absence of the SAP channel signal (hereinafter referred to simply as the "SAP signal") is not transmitted.

FIG. 9 is a block diagram showing a receiver for sound multiplex broadcast according to this system.

The receiver shown comprises an input terminal 1 for receiving a composite audio signal (including L+R signal L−R signal and SAP signal), a 50 KHz low-pass filter 2 for passing the L+R signal and the L−R signal therethrough, an L+R signal processing circuit 3 for demodulating the L+R signal included in the low-pass filter output, an L−R signal processing circuit 4 for similarly demodulating the L−R signal, a matrix circuit 5 for receiving the demodulated L+R signal, a first switch 6 for receiving the demodulated L−R signal at a terminal a, a 5 fH (fH: horizontal scanning line frequency of 15.734 KHz) band-pass filter 7 for passing therethrough the SAP signal from the input terminal 1, a SAP signal detecting circuit 8 for detecting the SAP signal from the band-pass filter output, and a low-pass filter 9 for passing therethrough the SAP signal demodulated by the detecting circuit 8. The output of the low-pass filter 9 is fed to a terminal b of the first switch 6. The output of the first switch 6 is fed to a noise reduction circuit 10 of the dBx type which comprises, for example, CXA1011P, an IC manufactured by SONY Corporation. Indicated at 11 is a second switch for feeding the output of the noise reduction circuit 10 to the matrix circuit 5 via a terminal a or to the third switch 12 to be mentioned below via a terminal b. The third switch 12, which is a double switch, has a pair of terminals b connected to the terminal b of the second switch 11 and a pair of terminals a to which the L signal and R signal from the matrix circuit 5 are fed individually. Amplifiers 13 and 13 amplify the outputs of the third switch 12. The output of each amplifier 13 is fed to a speaker 14. The first to third switches are operatively connected together and are closed at the terminals a when the main channel audio signal is selected, or alternatively, at the terminals b when the subchannel audio signal is selected.

With the noise reduction system of the above receiver, the L−R signal and the SAP signal to be transmitted is level-compressed by a dBx encoder. As seen in FIG. 8, the L−R signal is DSB (double-sideband) amplitude-modulated, and the SAP signal is frequency-modulated, before transmission.

When no noise component is contained in the SAP signal output from the low-pass filter 9 of the receiver of FIG. 9, the RMS detecting circuit (not shown) within the noise reduction circuit 10 operates normally.

With reference to FIG. 10, the audio source level (a) is compressed to (b) at the transmitting side, and if b=b1, the compressed level is restored to a=a1 at the receiving side, hence no problem.

However, (b is not equal to (b1) since the output of the low-pass filter 9 contains noise components such as video bass signal component, signal component due to the influence of flux from the deflection yoke or the like, and triangular noise component due to the frequency modulation of the SAP signal. These noise components are combined with the SAP signal, producing an error in the operation of the RMS detecting circuit included in the noise reduction circuit.

Accordingly, when a weak electric field is received and also when a medium-to-strong electric field is received, the demodulated SAP signal exhibits such frequency characteristics as represented by (a) and (b) in FIG. 11. When the signal received is of weak electric field, a greatly increased gain results, while if the signal is of medium-to-strong field, an increased gain also results although it is not so great as in the former case. Thus, the prior art has the drawback that the distortion factor (c) shows a peak at around 1 KHz to entail an increased sound volume.

SUMMARY OF THE INVENTION

The present invention, which has been accomplished in view of the foregoing problem, provides a sound multiplex broadcast receiver which is adapted to correct the frequency characteristics of the SAP signal when the characteristics are locally impaired by noise so as to give substantially flat frequency characteristics to the output of the noise reduction circuit.

More specifically, the present invention provides a sound multiplex broadcast receiver including a demodulation circuit for demodulating a main channel audio signal and a subchannel audio signal included in the signal received, and a noise reduction circuit for reducing noise by expanding the level of the subchannel audio signal compressed before transmission. The receiver comprises a frequency correction circuit connected between the demodulation circuit and the noise reduction circuit for correcting the frequency characteristics of the demodulated subchannel audio signal by diminishing the gain at a specific frequency where the distortion factor of the noise reduction circuit reaches a peak, and a noise detection circuit for detecting the level of noise in the subchannel audio signal received to vary the amount of correction by the correction circuit in accordance with the noise level. The corrected subchannel audio signal can be delivered from the noise reduction circuit with substantially flat frequency characteristics.

DESCRIPTION OF THE PREFERRED EMBODIMENTS

Embodiments of the present invention will be described below with reference to the drawings.

Figure 1:
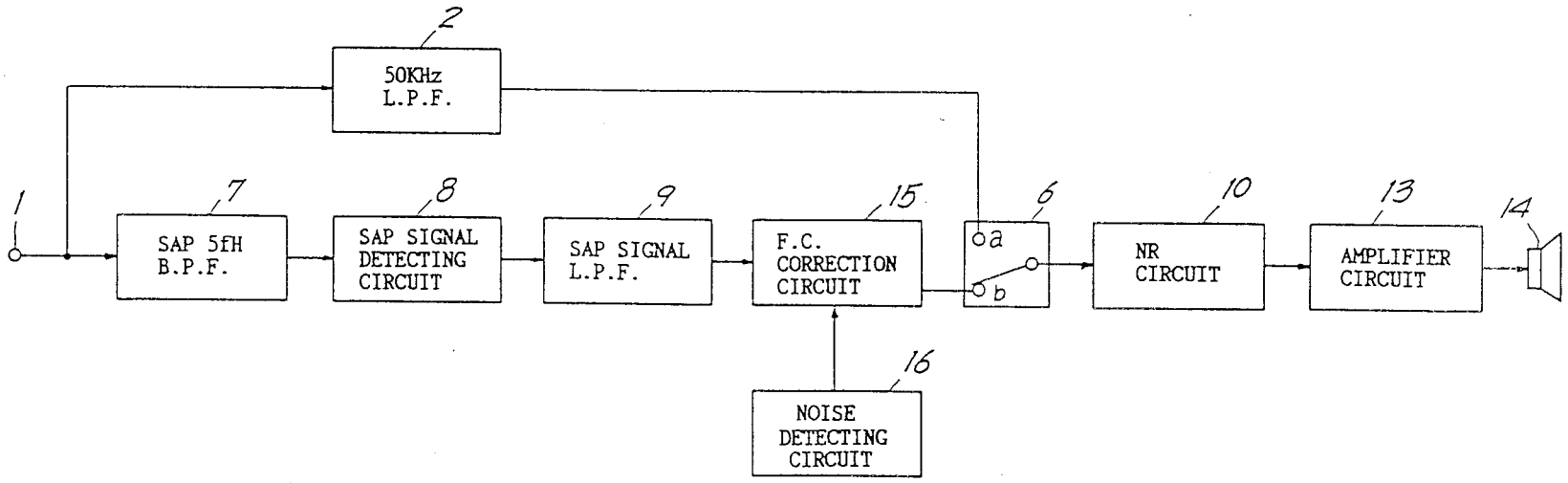
FIG. 1 is a block diagram showing a sound multiplex broadcast receiver embodying the invention.
Figure 2:
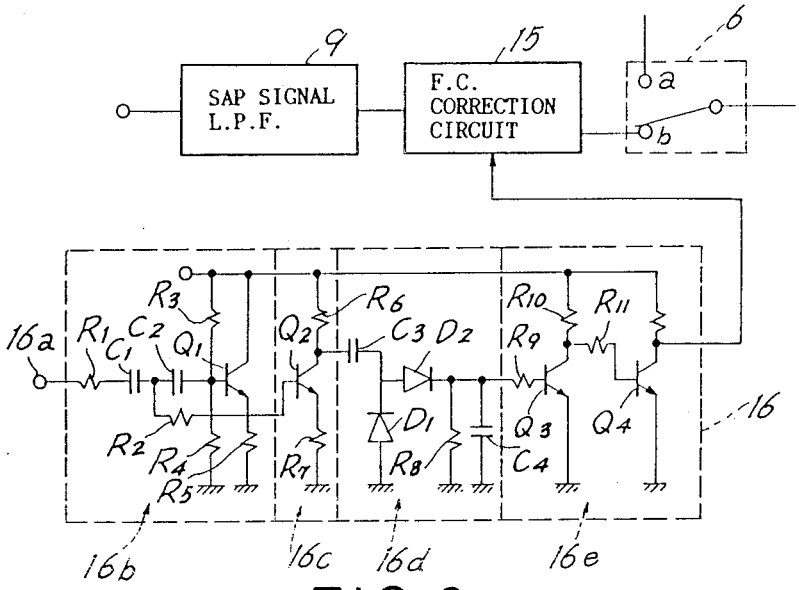
FIG. 2 is a fragmentary circuit diagram showing another, embodiment of the invention.

FIG. 1 illustrates the construction of a receiver embodying the invention for receiving two different audio signals transmitted by a multiplex system. FIG. 2 shows the main circuitry only of the invention as embodied for the circuit of FIG. 9. The embodiment of FIG. 2 includes a circuit for reproducing the main channel stereophonic audio signal in a similar manner as the conventional receiver of FIG. 1.

Figure 9:
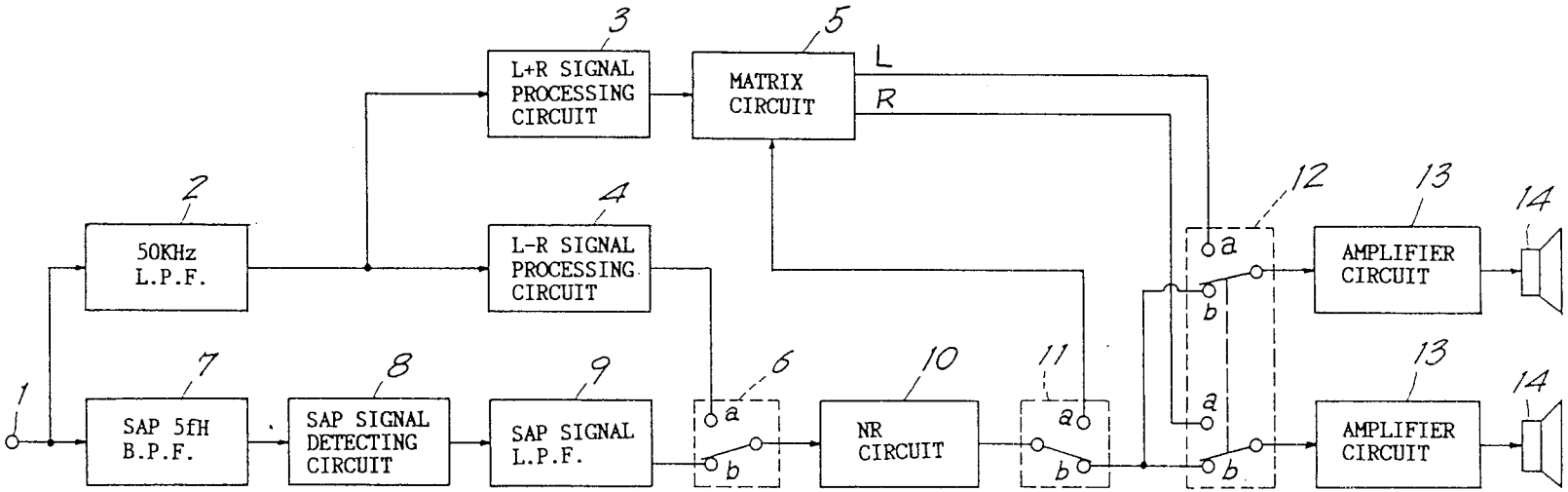
FIG.9 PRIOR ART
FIG. 9 is a block diagram showing a conventional sound multiplex broadcast receiver.

The embodiment of FIG. 1 is in common with the receiver of FIG. 9 with respect to the circuits 2, 6, 7, 8, 9, 10 and 13. The circuits 3, 4, 5, 11 and 12 for stereophonic broadcast are omitted from FIG. 1. Provided between the low-pass filter circuit 9 and the switch circuit 6 is a frequency characteristics correction circuit 15, to which a noise detection circuit 16 is connected for selectively changing the amount of correction to be effected by the circuit 15 in accordance with the noise level.

With reference to the embodiment of FIG. 1, the main channel audio signal included in the signal received by the intput terminal 1 is separated from a subchannel audio signal by the 50 KHz low-pass filter circuit 2 and is fed to a terminal a of the switch circuit 6. When the switch circuit 6 is closed at the terminal a, the main channel audio signal is passed through the switch circuit 6, noise reduction circuit 10 and amplifier circuit 13 and reproduced at the speaker 14 as already known. When the switch circuit 6 is closed at a terminal b, the subchannel audio signal is passed through the 5 fH band-pass filter circuit 7, detecting circuit 8 and low-pass filter circuit 9 for demodulation.

Figure 6:
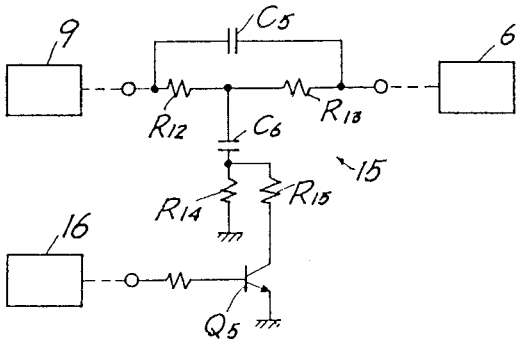
FIGS. 6 and 7 are diagrams showing different frequency characteristics correction circuits embodying the invention.
Figure 7:
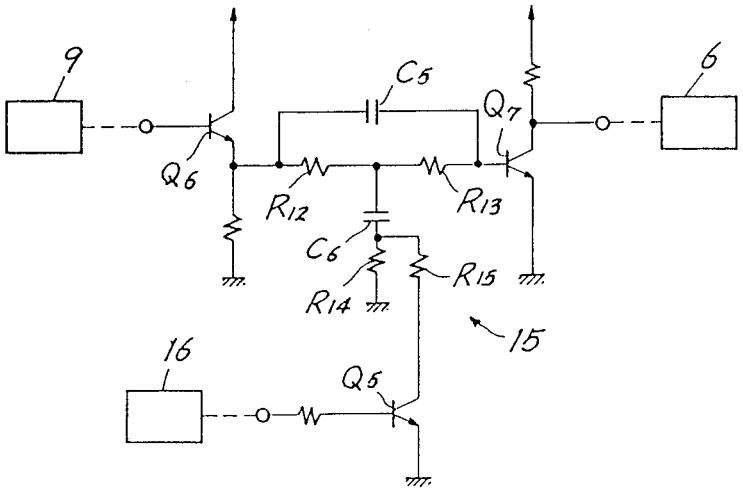
Figure 8:
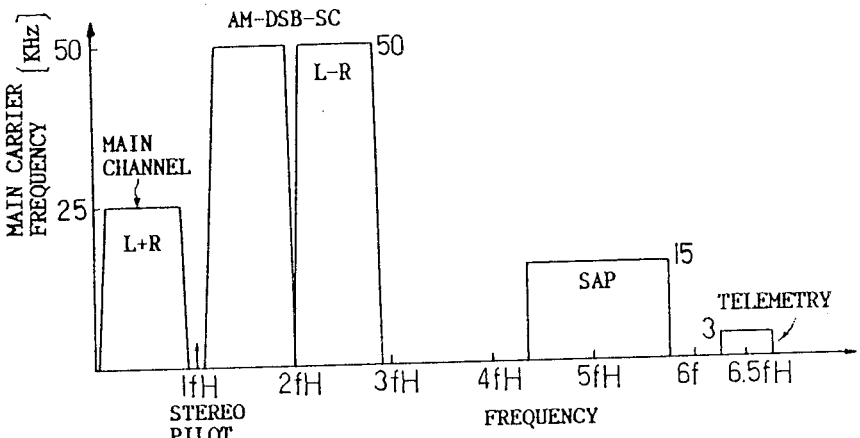
FIG.8 PRIOR ART
FIG. 8 is the frequency spectrum of sound multiplex signals in the U.S.
Figure 10:
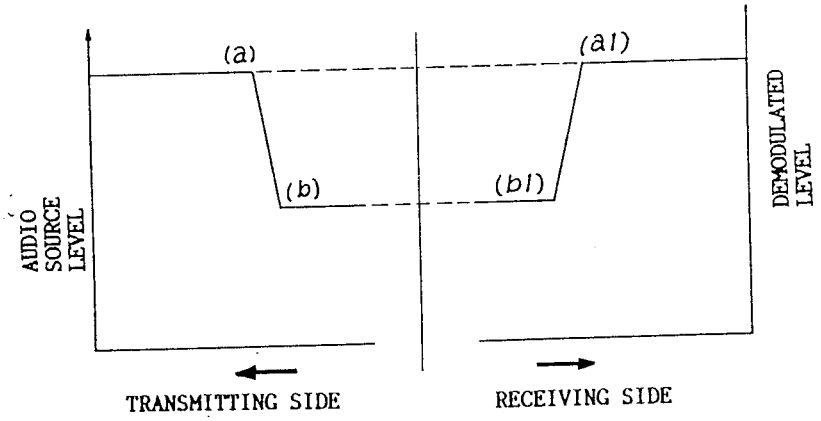
FIG. 10 is a diagram showing the principle of noise reduction.

The circuit of FIG. 6 or 7 is usable as an example of the frequency characteristics correction circuit 15. The same noise detection circuit 16 as shown in FIG. 2 is usable as the circuit 16 of FIG. 1.

The embodiment of FIG. 1 has the same construction as the receiver of FIG. 9 except that a frequency characteristics correction circuit 15 and a noise detection circuit 16 are incorporated into the receiver of FIG. 9 between the low-pass filter 9 and the first switch 6. When the first switch 6 is closed at the terminal b for reproducing the subchannel audio signal, the embodiment of FIG. 2 performs the same action as that of FIG. 1, so that a further description will be given with reference to the circuits of FIGS. 2, 6 and 7.

Figure 3:
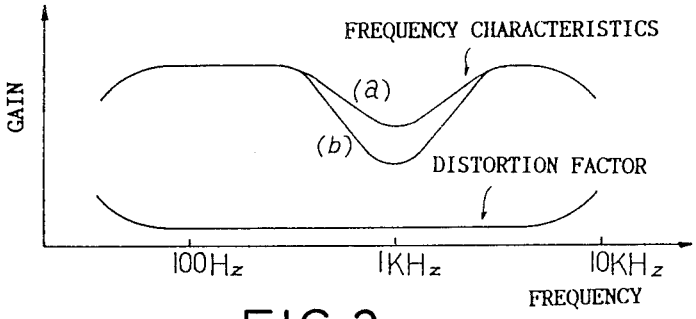
FIG. 3 is a characteristics diagram of a frequency characteristics correction circuit.
Figure 11:
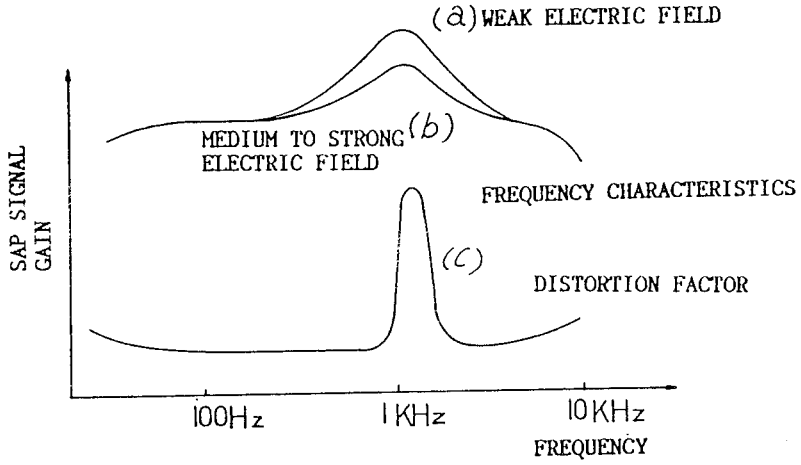
FIG.11 PRIOR ART
FIG. 11 is a diagram showing the characteristics of a SAP signal delivered from a conventional noise reduction circuit.

The frequency characteristics correction circuit 15 is adapted to correct the frequency characteristics of the SAP signal shown in FIG. 11, affording the characteristics represented by (a) in FIG. 3 while a medium-to-strong electric field is received, or those represented by (b) when the signal received is of weak electric field.

Figure 4:
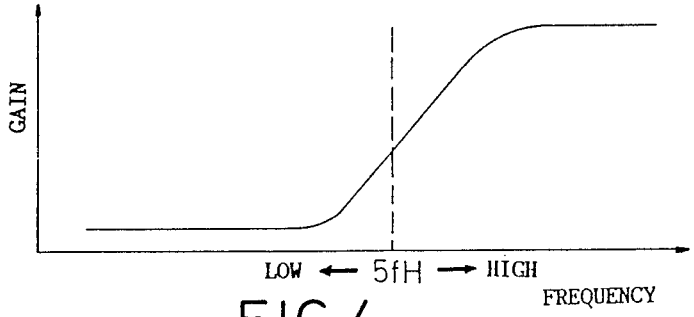
FIG. 4 is a characteristics diagram of a high-pass filter.

The change between the characteristics (a) and (b) is effected according to the output of the noise detection circuit 16. The circuit 16 detects noise components of high frequencies not lower than the SAP channel band and comprises an input terminal 16*a*, high-pass filter 16*b*, a periodic wideband amplifier 16*c*, rectification smoothing circuit 16*d* and buffer circuit 16*e*. A composite audio signal is applied to the input terminal 16*a*. The high-pass filter 16*b* comprises capacitors Cl, C2, a transistor Ql, resistors Rl to R5, etc. and transmits high-frequency components of at least 5 fH as shown in FIG. 4. The amplifier 16*c* comprises a transistor Q2 and resistors R6, R7. The rectification smoothing circuit 16*d* comprises diodes Dl, D2, capacitors C3, C4, a resistor R8, etc. The buffer circuit 16*e* comprises transistors Q3, Q4 and resistors R9 to Rll. The output of the noise detection circuit is applied to the frequency characteristics correction circuit 15.

The operation of the noise detection circuit 16 will be described below.

Figure 5:
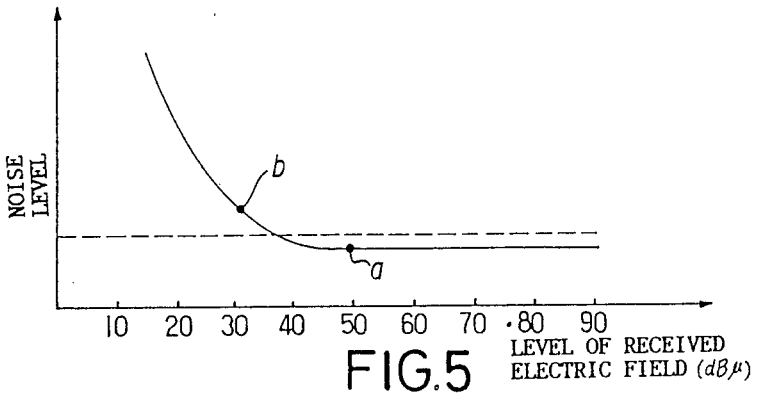
FIG. 5 is a noise level characteristics diagram.

When a medium-to-strong electric field is received, the level of noise of at least the SAP channel band included in the composite sound signal at the input terminal 16*a* is low as represented by a point (a) in FIG. 5. Consequently, the output of the rectification smoothing circuit 16*d* is at a low level, turning off the transistor Q3 and bringing the transistor Q4 into conduction in the buffer circuit 16*e*. The output of the noise detection circuit 16 is therefore low.

On the other hand, when a weak electric field is received, the noise level is high and above a dotted line (noise detection level), as for example represented by a point (b) in FIG. 5. The output of the rectification smoothing circuit 16*d* is therefore high, bringing the transistor Q3 into conduction and the transistor Q4 out of conduction and consequently causing the noise detection circuit 16 to produce a high output. The noise detection level, although somewhat varying from receiver to receiver, is about 40 mVp-p for the input to the noise reduction IC of the dBx type.

The frequency characteristics correction circuit 15 will be described next.

Figure 12:
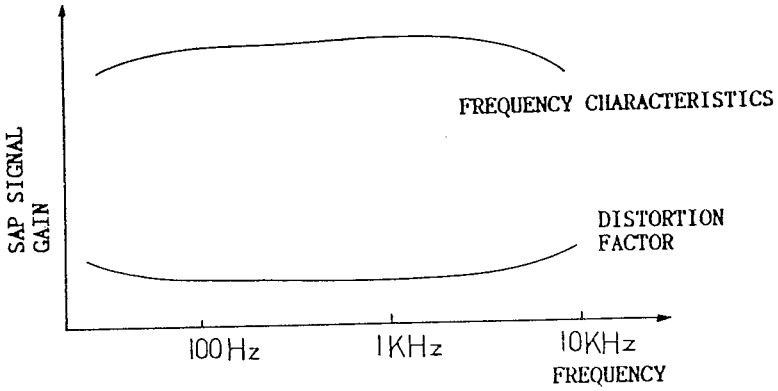
FIG. 12 is a diagram showing the SAP signal characteristics available by a noise reduction circuit embodying the invention.

FIG. 6 shows a specific example of frequency characteristics correction circuit 15. When a medium-to-strong electric field is received, the frequency characteristics of the circuit slightly attenuate at around 1 KHz as represented by the curve (a) in FIG. 3 by virtue of the constant of the filter provided by capacitors C5, C6 and resistors R12, R13, R14. Since the frequency of greatest attenuation is made to approximately coincide with the frequency where the distortion factor (c) of the noise reduction circuit 10 reaches a peak as shown in FIG. 11, the frequency characteristics of the SAP signal represented by the curve (b) in FIG. 11 and mentioned previously can be corrected so as to be flat in the vicinity of 1 KHz as seen in FIG. 12.

On the other hand, when a weak electric field is received, the high output of the noise detection circuit 16 is applied to the base of a transistor Q5 to turn on this transistor, whereby a resistor R15 is connected in parallel with the resistor R14. An increased amount of attenuation therefore occurs around 1 KHz as represented by (b) in FIG. 3, with the result that the frequency characteristics of the SAP signal represented by the curve (a) in FIG. 11 and mentioned above can be corrected to a flat form in the vicinity of 1 KHz as shown in FIG. 12.

Thus, the amount of correction by the correction circuit 15 is selectively altered in accordance with the state of the electric field received. This makes it possible for the noise reduction circuit 10 to produce a SAP signal output of flat frequency characteristics irrespective of the state of the electric field received.

FIG. 7 shows another frequency characteristics correction circuit embodying the invention. When the network impedance connected to the input terminal is high and when the network impedance connected to the output terminal is low in the circuit of FIG. 7, emitter-follower transistors Q6 and Q7 are provided at the input and output terminals, respectively, for impedance conversion to prevent impairment of the frequency characteristics.

Thus, the sound multiplex broadcast receiver of the present invention is adapted to correct the frequency characteristics of the subchannel audio signal by an altered amount in accordance with the intensity of electric field received.

Accordingly, even if the frequency characteristics of the SAP signal are locally impaired by noise in the noise reduction circuit, the characteristics can be corrected, permitting the reduction circuit to give an output with substantially flat frequency characteristics regardless of the state of the signal received. This serves to diminish the distortion factor and prevents the increase in the sound volume at a specific frequency.

The construction of the receiver of the present invention is not limited to the foregoing embodiments but can be modified variously within the technical scope defined in the appended claims.

What is claimed is:

1. A sound multiplex broadcast receiver including a demodulation circuit for demodulating a sound multiplex television signal including a main channel audio signal and a subchannel carrier wave audio signal, and a noise reduction circuit for reducing noise by expanding the level of the subchannel audio signal, which was compressed before transmission said noise reduction circuit introducing undesired frequency distortion, said sound multiplex broadcast receiver further comprising:

a frequency characteristics correction circuit responsive to the subchannel audio signal for correcting the frequency characteristics of the subchannel audio signal by diminution at a frequency where said distortion of the noise reduction circuit reaches a peak; and a noise detection circuit connected to the frequency characteristics correction circuit for detecting the level of noise in the subchannel audio signal received to vary the amount of correction by the correction circuit in accordance with the output of the detection circuit so that the frequency characteristics correction circuit effects a great diminishing correction when the sound multiplex television signal received has a weak electric field and a small diminishing correction when the received sound multiplex television signal has a medium-to-strong electric field to give an output with substantially flat frequency characteristics, regardless of the state of the signal received.

2. The sound miltiplex broadcast receiver of claim 1 wherein the main channel audio signal includes a stereophonic sum channel signal, a stereophonic difference subcarrier channel signal and a stereophonic pilot signal between the bands of the sum and difference channel signals, and the demodulation circuit includes a circuit for processing the stereophonic sum channel signal, a circuit for processing the stereophonic difference channel signal, the noise reduction circuit, and a matrix circuit for receiving the output of the sum channel signal processing circuit and the output of the noise reduction circuit to convert the outputs into stereophonic main audio signals.

* * * * *